United States Patent [19]

Chia

[11] 3,988,120

[45] Oct. 26, 1976

[54] METHOD OF DESULFURIZING COAL

[76] Inventor: Tung-Yu Chia, 32-50, 70th St., Apt. 5J, East Elmhurst, N.Y. 11370

[22] Filed: Nov. 26, 1974

[21] Appl. No.: 527,442

[30] Foreign Application Priority Data

May 9, 1974 Japan ..... 49-50778

[52] U.S. Cl. ..... 44/1 R; 201/17

[51] Int. Cl.[2] ..... C10L 9/10; C10B 57/08

[58] Field of Search ..... 44/1 R, 1 A, 1 B, 1 G, 44/6; 201/17; 75/6

[56] References Cited

UNITED STATES PATENTS

| | | | |
|---|---|---|---|
| 1,688,695 | 10/1928 | Esselen, Jr. et al. | 44/1 R |
| 1,971,683 | 8/1934 | Holst, Jr. | 44/6 |
| 3,893,943 | 7/1975 | Willard, Sr. | 252/455 R |

FOREIGN PATENTS OR APPLICATIONS

| | | | |
|---|---|---|---|
| 173,072 | 12/1921 | United Kingdom | 44/1 R |

*Primary Examiner*—Carl F. Dees
*Attorney, Agent, or Firm*—Flynn & Frishauf

[57] ABSTRACT

A method of desulfurizing high sulfur low grade coal by immerising it in an aqueous solution of a polar compound containing nonpolar groups bonded with polar groups, thereby providing low sulfur coal.

7 Claims, No Drawings

METHOD OF DESULFURIZING COAL

BACKGROUND OF THE INVENTION

This invention relates to a method of desulfurizing high sulfur low grade coal, and more particularly to a method of desulfurizing coal to provide suitable coal for use as fuel.

Coal is generally applied in a wide field as fuel for various types of boilers and turbines as well as for household use and in addition as raw material for production of city gas and coke. In recent years, demand has been made for use of low sulfur coal as a measure of preventing air pollution which poses a serious social problem. Since low sulfur coal is produced in small quantities and in consequence is very costly, it has been considered necessary to discover an economical process of converting high sulfur inexpensive coal into low sulfur coal. Further, it can not be denied that there arises a situation where even high sulfur low grade coal which has so far been deemed unavailable for practical use has to be introduced into the field of fuel as a measure of resolving the worldwide energy crisis, for example, the global shortage of petroleum which has come to be keenly felt since the end of 1973.

SUMMARY OF THE INVENTION

This invention has been accomplished in view of the above-mentioned situation with the object of desulfurizing high sulfur low grade coal to provide low sulfur coal, thereby contributing to the fuel revolution now strongly demanded all over the world. Namely, this invention is characterized by immersing coal powders in an aqueous solution of a polar compound containing nonpolar groups bonded with polar groups and washing and drying the immersed mass for desulfurization, thereby providing low ash and high calorie coal.

DETAILED DESCRIPTION OF THE INVENTION

The nonpolar and polar groups included in a polar compound used in this invention are listed below. It will be noted that as used herein, the terms "nonpolar and polar groups" are not applied in a rigid sense. Namely, the nonpolar group means a nonpolar or low polar group and the polar group denotes a high polar group.

| Nonpolar groups | | |
|---|---|---|
| 1. | Alkyl group | R— |
| 2. | Alkyl group containing carboxylate | —R—CO . O—R— |
| 3. | Alkyl group containing ether linkage | —R—O—R— |
| 4. | Alkyl group containing acid amide linkage | —R—CO . NH—R— |
| 5. | Phenyl group | 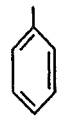 |
| 6. | Alkylphenyl group | 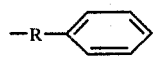 |
| 7. | Alkylnaphthalene group | 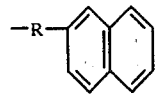 |
| 8. | Alkyldiphenyl group | 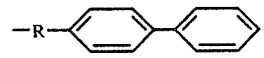 |
| 9. | Alkylbenzimidazole group | 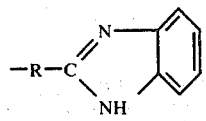 |
| 10. | Cyclopentyl group | 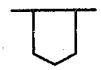 |
| 11. | Abietic acid ring | 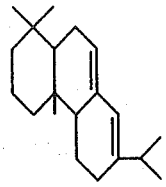 |
| **Polar groups** | | |
| 1. | Sulfate group | $-OSO_3H(M)$ |

-continued

| | | |
|---|---|---|
| 2. | Sulfonic group | $-SO_3H(M), \begin{matrix} SO_3H(M) \\ SO_3H(M) \end{matrix}$ |
| 3. | Carboxylate group | $-COOH(M)(R), \begin{matrix} COOH(M)(R) \\ COOH(M)(R) \end{matrix}$ |
| 4. | Sulfocarboxylate group | $HSO_3-\underset{\underset{CH_2COOH(M)(R)}{\vert}}{CH}.COO-$ |
| 5. | Carbonyl group | $>CO$ |
| 6. | Phosphate group | $-OPO(OH)_2, -OPO(OM)_2$<br>$-OPO(OH), -OPO(OM)$ |
| 7. | Amide | $-NH_2, -NH_2-HX$<br>(amide hydrogen halide group) |
| 8. | Imide group | $>NH$ |
| 9. | Acid amide group | $-CONH_2(-CONH-, -CO.N<)$ |
| 10. | Mercapto group | $-SH$ |
| 11. | Thiocarbonyl group | $>CS, -CS.SH$<br>(thiocarbonyl mercapto group) |
| 12. | Cyano group | $-CN$ |
| 13. | Thiocynate group | $-CNS$ |
| 14. | Nitro group | $-NO_2$ |
| 15. | Hydroxyl group | $(-OH)_{n'}$ n'=1 to 6 |
| 16. | Halogen group | $-X$ |
| 17. | Ether linkage | $-O-(-R.O.R', -C_6H_4-O-R, -C_6H_4-O-R-)$ |
| 18. | Polyethylene oxide group | $(-CH_2-CH_2-O-)_n$ |
| 19. | Polyethylene amide group | $(-CH_2-CH_2-NH-)_n$ |
| 20. | Quarternary ammonium group | $-\overset{\vert}{\underset{\vert}{N}}-$ |
| | Halogenized quarternary ammonium group | $\left[-\overset{\vert}{\underset{\vert}{N}}-\right]\cdot X$ |
| | Sulfocarbonyl quarternary ammonium group | $-SO_3-\overset{H}{\underset{H}{N}}-CO-$ |
| 21. | Sulfonate tertiary amide group | $-\overset{\vert}{\underset{SO_3H(M)}{N}}-$ |

The alkyl groups R and R', each usually contain 10–20 carbon atoms (preferably 10–15 carbon atoms). Alkyl groups of 10–13 carbon atoms, e.g., lauryl, are most preferred. The repeating groups $n$ are usually 1–10 units, with the range of $n = 3$–10 more preferred, and the range of 5–10 most preferred. M is $NH_4$ or an alkali metal, with sodium and potassium being the first and second preferences among the alkali metals. X is a halogen. The preferred halogens, listed in order of preference, are chloride, bromine, and iodine.

Although a polar compound containing any combination of the above-listed nonpolar and polar groups is available for the object of this invention, the preferred types are the polar compounds of the following sixteen numbered formulas, with such polar compounds having less than twenty-five carbon atoms being particularly preferred.

| | | |
|---|---|---|
| 1. | Alkyl sulfate | $R-OSO_3M$ |
| 2. | Alkyl sulfonate | i) $R-SO_3M$<br>ii) $R-\underset{\underset{SO_3M}{\vert}}{CH}-R$ |

-continued

| | |
|---|---|
| 3. Alkylaryl sulfonate | i) 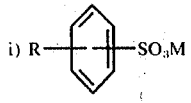 ii) 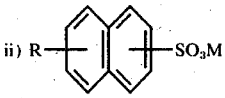 |
| 4. α-sulfonated fatty acid | $R-\underset{\underset{SO_3H}{\vert}}{CH}-COOH$ |
| 5. α-sulfonated fatty ester | $R-\underset{\underset{SO_3M}{\vert}}{CH}-COOR'$ |
| 6. Dialkyl succinate | $R-O\,.\,OC-CH_2-\underset{\underset{SO_3M}{\vert}}{CH}-COOR$ |
| 7. Fatty acid benzimidazoline | 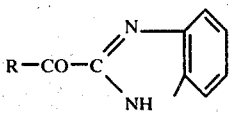 |
| 8. Succinic amide alkylester sulfonate | $MO_3S-\underset{\underset{CH_2-COOM}{\vert}}{CH}-CONH-R$ |
| 9. Polyoxyethylene alkyl ether | $R-O-(CH_2CH_2O)_nH$ |
| 10. Polyoxyethylene alkylphenol ether | 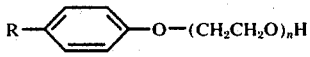 |
| 11. Polyoxyethylene polyol fatty ester | $(CH_2CH_2O)_n-\underset{\underset{CH_2COOR}{\vert}}{CHCOOR}$ |
| 12. Polyoxyethylene alkylamine | $RN\begin{matrix}/(CH_2CH_2O)_nH\\ \backslash(CH_2CH_2O)_nH\end{matrix}$ |
| 13. Alkylpyridinium halide | 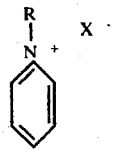 |
| 14. Alkyl phosphate | $R\,.\,OPO(OM)_2$ |
| 15. Alkylaryl phosphate | 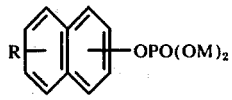 |

The R and/or R′ groups and values of the integer $n$ are selected so that the aforelisted compounds contain less than 25 carbon atoms. The compounds used in the Examples fall within the preferred values of $n$.

Raw coal for this invention may consist of any of peat, lignite, brown coal, bituminous coal and anthracite. Though freely selectable, the particle size of raw coal powders is preferred to be between about 50 mesh and 200 mesh. Larger particles are also desulfurized, but with a lesser degree of effectiveness because of the larger mass relative to the surface area. Particles finer than 200 mesh are effectively treated by the process of this invention. However, the additional cost of the comminution necessary to produce minus 200 mesh powder may not be economically feasible.

The coal desulfurizing process of this invention comprises the following steps. Powders of the above-mentioned raw coal are immersed in an aqueous solution of any of the above-listed polar compounds having a prescribed concentration of, for example 0.01 to 1.0% for a sufficient time to substantially lower the sulfur content.

The aqueous solution preferably contains between about 0.01 and 0.06% with 0.03–0.06% most preferred.

The temperature of the aqueous solution is preferably ambient temperature, with up to about 40° C preferred, i.e., 0°–40° C. The immersion time is preferably between about 90 and 120 minutes. A longer immersion (which is more costly) does not appear to improve the product and a shorter immersion may not be sufficient to sufficiently lower the sulfur content.

The coal powders are desired to bear a weight ratio of 1:3 to 5 to the aqueous solution of the polar compound. The coal powders taken out of the solution are washed to eliminate impurities, followed by drying. If the concentration and temperature of the aqueous solution of the polar compound are not considered to bear a great economical importance, said concentration and temperature may be higher.

As described above, the coal-desulfurizing process of this invention is very simple and economical.

EXAMPLE 1

A plurality of 2 kg lots of 200 mesh powders of brown coal were respectively immersed in aqueous solutions each weighing 8 kg and containing the eight kinds of polar compounds given in Table 1 below. Said immersion was continued 100 minutes while stirring was carried out sometimes. The respective polar compound solutions had concentrations and temperatures shown in Table 1 below opposite to the corresponding polar compounds. Upon completion of immersion, the brown coal powders were removed, washed 10 times with 10 liters of running water and dried 12 hours at 150° C, providing desulfurized coal. Table 2 below indicates the sulfur content, ash content and calorie of coal powders before and after treated by the aforesaid eight kinds of polar compounds for desulfurization.

Table 1

| Example No. | Polar Compounds | Concentration of an aqueous solution containing a polar compound (% by weight) | Temperature of a polar compound solution in which the coal powders were immersed (%) |
|---|---|---|---|
| 1 | Lauryl sulfate | 0.14 | 20 |
| 2 | Lauryl sulfate | 0.04 | 40 |
| 3 | Oleyl sulfate | 0.13 | 20 |
| 4 | Oleyl sulfate | 0.02 | 35 |
| 5 | Sodium oleylmethyl amino ethane sulfonate | 0.11 | 20 |
| 6 | Sodium oleylmethyl amino ethane sulfonate | 0.01 | 35 |
| 7 | Sodium dibutyl-naphthalene sulfonate | 0.10 | 20 |
| 8 | Sodium dibutyl-naphthalene sulfonate | 0.05 | 35 |
| 9 | Polyoxyethylene dodecylphenol ether | 0.11 | 20 |
| 10 | Polyoxyethylene dodecylphenol ether | 0.03 | 35 |
| 11 | Sorbitan mono-laurate poly-glycol ether | 0.10 | 20 |
| 12 | Sorbitan mono-laurate poly-glycol ether | 0.05 | 35 |
| 13 | Oleyl sarcoside | 0.15 | 20 |
| 14 | Oleyl sarcoside | 0.04 | 35 |
| 15 | Sodium di(n-octyl) sulfosuccinate | 0.05 | 20 |
| 16 | Sodium di(n-octyl) sulfosuccinate | 0.02 | 35 |

Table 2

| Samle No. | | Sulfur content (% by weight) | Ash Content (% by weight) | Calorie (BTU/lb) |
|---|---|---|---|---|
| Untreated coal | 1 | 11.63 | 41.88 | 7,688 |
| | 2 | 11.56 | 40.24 | 7,851 |
| Desulfurized coal | 1 | 5.22 | 34.59 | 9,182 |
| | 2 | 5.39 | 34.93 | 9,156 |
| | 3 | 5.34 | 35.11 | 9,208 |
| | 4 | 5.63 | 35.61 | 9,105 |
| | 5 | 5.28 | 34.63 | 9,185 |
| | 6 | 5.23 | 34.71 | 9,134 |
| | 7 | 5.39 | 34.77 | 9,213 |
| | 8 | 5.44 | 35.91 | 9,159 |
| | 9 | 5.30 | 35.47 | 9,202 |
| | 10 | 5.34 | 35.44 | 9,202 |
| Desulfurized coal | 11 | 5.29 | 36.02 | 9,020 |
| | 12 | 5.28 | 34.88 | 9,178 |
| | 13 | 5.31 | 35.17 | 9,184 |
| | 14 | 5.28 | 35.15 | 9,210 |
| | 15 | 5.47 | 36.67 | 9,039 |
| | 16 | 5.40 | 35.20 | 9,158 |

1 Analysis was made on the dry basis.
2 Desulfurized coal samples Nos. 1 to 16 were respectively treated by the aqueous solution of the polar compounds given in Table 1 above.

Table 2 shows that the coal desulfurized by the process of this invention is far more reduced in sulfur content and ash content and more prominently increased in calorie than that which is not desulfurized, proving that said desulfurized coal is well adapted for use particularly as fuel.

The whereabouts or the final destination of the sharply decreased portion of the sulfur content of coal may be academically traced as follows.

Originally, coal contains sulfur presumably in the forms of (1) sulfide, (2) organic compound and (3) sulfate. When untreated coal is burned, the organic sulfur compound of the item (2) is shifted into the tar of the coal and the sulfate of the item (3) is deoxidized into sulfide. On the other hand, excess sulfur or atomic sulfur adhering to the sulfide of the item (1) is oxidized into $SO_2$, giving rise to air pollution.

Where coal is treated by the polar compound of this invention, the excess sulfur adherent to the sulfide of the item (1) which is supposed to cause air pollution is ionized to combine with a metal ion co-existing in the coal, providing water-soluble or water-insoluble sulfide. When the above-mentioned excess sulfur combines with, for example, Na or K, then water-soluble sulfide is formed. When said excess sulfur combines with, for example, Fe, then water-insoluble sulfide is produced. The water-soluble sulfide is eliminated by water washing, while the water-insoluble sulfide is retained in the coke obtained by the burning of treated coal. In either case, therefore, coal treated by the polar compound of this invention does not substantially lead to air pollution.

What is claimed is:

1. A method of desulfurizing coal which comprises immersing powdered coal in an aqueous solution of a polar compound containing a nonpolar group bonded to a polar group and then washing the immersed coal, followed by drying said coal; said polar compound being selected from the group consisting of (a) alkyl sulfate $R-SO_3M$ (b) alkyl sulfonate i) $R-SO_3M$ ii) $R-CH(SO_3M)-R$ (c) α-sulfonated fatty acid $$R-\underset{\underset{SO_3H}{|}}{CH}-COOH$$

(d) dialkyl succinate $$R-O\,.\,OC-CH_2-\underset{\underset{SO_3M}{|}}{CH}-COOR$$

(e) fatty acid benzimidazoline

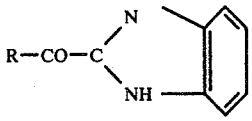

(f) succinic amide alkyl ester sulfonate $$MO_3S-\underset{\underset{CH_2-COOM}{|}}{CH}-CONH-R$$

(g) polyoxyethylene alkyl ether $$R-O-(CH_2CH_2O)_nH$$

(h) polyoxyethylene alkylphenol ether

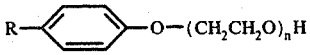

(i) polyoxyethylene polyol fatty ester $$(CH_2CH_2O)_n-\underset{\underset{CH_2COOR}{|}}{CHCOOR}$$

(j) polyoxyethylene alkylamine $$RN\begin{matrix}(CH_2CH_2O)_nH\\(CH_2CH_2O)_nH\end{matrix}$$

(k) alkylpyridinium halide

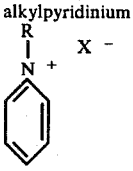

(l) alkyl phosphate $R\,.\,OPO(OM)_2$ (m) alkylaryl phosphate

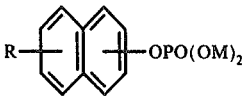

wherein R and R′ are alkyl groups having between about 10 and 20 carbon atoms, M is selected from the group consisting of $NH_4$ and alkali metals, X is a halogen and $n$ is an integer from 1 to about 10.

2. A method according to claim 1 wherein the polar compound has less than 25 carbon atoms.

3. A method according to claim 2 wherein $n$ is 3–10, M is sodium or potassium, X is chlorine, bromine or iodine, and R and R′ are alkyl groups having 10–15 carbon atoms.

4. A method according to claim 3 wherein $n$ is 5–10.

5. A method according to claim 1 wherein the aqueous solution of the polar compound has a concentration of 0.01 to 1% by weight and the coal powders bear a weight ratio of 1:3 to 5 to said aqueous solution.

6. A method according to claim 2 wherein the aqueous solution of the polar compound has a concentration of 0.01 to 1% by weight and the coal powders bear a weight ratio of 1:3 to 5 to said aqueous solution.

7. A method according to claim 3 wherein the aqueous solution of the polar compound has a concentration of 0.01 to 1% by weight and the coal powders bear a weight ratio of 1:3 to 5 to said aqueous solution.

* * * * *